US005811702A

United States Patent [19]

Tomizawa et al.

[11] Patent Number: 5,811,702

[45] Date of Patent: Sep. 22, 1998

[54] KEYBOARD MUSICAL INSTRUMENT HAVING HAMMER HEADS FORMED OF METALLIC POWDER CONTAINING SYNTHETIC RESIN AND PROCESS OF FABRICATING HAMMER ASSEMBLY

[75] Inventors: Yasushi Tomizawa; Hiroyoshi Takahashi; Fumiyoshi Furuki; Takamitsu Suzuki, all of Hamamatsu, Japan

[73] Assignee: Yamaha Corporation, Shizuoka-ken, Japan

[21] Appl. No.: 722,914

[22] Filed: Sep. 23, 1996

[30] Foreign Application Priority Data

Sep. 25, 1995 [JP] Japan ..... 7-245874

[51] Int. Cl.[6] ..... G10C 3/18

[52] U.S. Cl. ..... 84/254; 84/423 R; 84/452 R

[58] Field of Search ..... 84/254, 423 R, 84/452 R

[56] References Cited

U.S. PATENT DOCUMENTS

| | | | |
|---|---|---|---|
| 934,654 | 9/1909 | Bode | 84/254 |
| 1,392,248 | 9/1921 | Cloetens | 84/254 |
| 3,805,662 | 4/1974 | Nishimura et al. | 84/254 |

*Primary Examiner*—Cassandra C. Spyrou
*Attorney, Agent, or Firm*—Hazel & Thomas

[57] ABSTRACT

A keyboard music instrument includes a keyboard, key action mechanisms functionally connected to keys of the keyboard, strings assigned notes of a scale and hammer assemblies for striking the strings. The hammer assemblies have respective hammer heads formed of metallic powder containing synthetic resin so as to exactly regulate the weight to target values.

4 Claims, 7 Drawing Sheets

KEYBOARD MUSICAL INSTRUMENT HAVING HAMMER HEADS FORMED OF METALLIC POWDER CONTAINING SYNTHETIC RESIN AND PROCESS OF FABRICATING HAMMER ASSEMBLY

FIELD OF THE INVENTION

This invention relates to a keyboard musical instrument and, more particularly, to a hammer head of metallic powder containing synthetic resin and a process of fabricating a hammer assembly.

DESCRIPTION OF THE RELATED ART

A piano is a typical example of the keyboard music instrument, and is responsive to a player's fingering on the keyboard. The key action mechanism transfers the force exerted on the black and white keys to the hammer assemblies, and the hammer assembly is driven for rotation. The hammer assembly strikes a set of music wires. Then, the music wires vibrate so as to generate acoustic sound with the note assigned to the depressed key. Thus, the hammer assembly is an indispensable component of the piano.

FIG. 1 illustrates a typical example of the hammer assembly 1 together with a key action mechanism 2. The hammer assembly 1 is turnably supported by a shank flange rail 3*a,* and the key action mechanism 2 is turnably supported by a whippen rail 3*b*. The shank flange rail 3*a* and the whippen rail 3*b* are fixed to action brackets (not shown), and the action brackets are mounted on a key bed (not shown).

A capstan screw 4*a* projects from a key 4*b,* and force exerted on the key 4*b* is transferred from the capstan screw 4*a* to the key action mechanism 2. A set of music wires 5 is stretched over the hammer assembly 1, and the key action mechanism 2 imparts kinetic energy to the hammer assembly 1 so as to strike the set of music wires 5.

The hammer assembly 1 includes a hammer shank flange 1*a* bolted to the shank flange rail 3*a,* a hammer shank 1*b* turnably connected to the hammer shank flange 1*a,* a hammer roller 1*c* rotatably connected to the hammer shank 1*b* and a hammer head 1*c* fixed to the leading end of the hammer shank 1*b*. While the hammer assembly 1*d* is resting at the home position, the hammer roller 1*c* is held in contact with a top surface of a jack 2*c* of the whippen assembly 2*a*.

The hammer head 1*d* is broken down into a hammer wood 1*e* and a hammer felt 1*f*. The hammer wood 1*e* is fixed to the leading end of the hammer shank 1*b* in such a manner to form a T-letter shape, and the hammer felt 1*f* is adhered to the hammer wood 1*e*. The names "hammer wood" and "hammer felt" are self-explanatory. The hammer wood 1*e* is usually formed of walnut or maple tree, and an under felt or a core is covered with a top felt. The hammer shank 1*b* is formed of wood such as birch or hornbeam.

Assuming now that a player depresses the key 4*b,* the key 4*b* is sunk from the rest position toward the end position, and the capstan screw 4*a* pushes up the whippen assembly 2*a*. The whippen assembly 2*a* turns in the counter clockwise direction, and the jack 2*c* causes the hammer shank 1*b* and the hammer head 1*d* to turn around the shank flange 1*a* in the clockwise direction.

When the toe of the jack 2*c* is brought into contact with the regulating mechanism 2*b,* the jack 2*c* is quickly rotated around the center pin 2*d* in the clockwise direction so as to impart kinetic energy to the hammer assembly 1. Then, the hammer assembly 1 starts a free rotation toward the set of music wires 5, and the hammer felt if strikes the music wires 5. The set of music wires 5 vibrates, and generates an acoustic sound. The hammer assembly 5 rebounds on the set of music wires 5, and returns to the initial position after release of the key 4*b*.

The hammer assembly 1 is expected to give the set of music wires 5 an impact large enough to generate the acoustic sound. The hammer felt if is held in contact with the set of strings 5 for a while, and the time interval for the contact affects the timbre of the acoustic piano sound. For this reason, the manufacturer carefully designs the hammer head 1*d,* i.e., the volume and the weight depending upon the notes of the scale assigned to the associated keys.

In the actual design work, the size of the hammer head is decreased from low-pitched tones through middle pitched tone to high-pitched tones. On the other hand, the hammer head becomes lighter from the low-pitched tones through the middle-pitched tones to the high-pitched tones. This design work is not easy, and increases the production cost.

Various prior art hammer assemblies are disclosed in Japanese Utility Model Publication of Unexamined Application No. 54-94221 (which is hereinbelow referred to "the first prior art"), Japanese Utility Model Publication of Examined Application No. 58-12216 (which is hereinbelow referred to "the second prior art") , Japanese Utility Model Publication of Examined Application No. 5-38399 (which is hereinbelow referred to "the third prior art") and Japanese Utility Model Publication of Unexamined Application No. 6-47995 (which is hereinbelow referred to "the fourth prior art").

The first hammer assembly for a piano disclosed in the first prior art includes a hammer head formed of rubber, and a weight is embedded in a hole formed in the piece of rubber. The weight is regulated depending upon the note ranges of the associated keys.

The second hammer assembly for a piano disclosed in the second prior art includes a hammer base formed of resilient hard rubber, and the hammer base is adhered to a hammer wood. The hammer base is covered with an outer skin of artificial leather, and is adhered thereto. The outer skin is directly brought into contact with the set of strings 5.

The third hammer assembly for a piano disclosed in the third prior art includes a wood base, synthetic resin plates attached to both side surfaces of the wood base except for the front end portion and a sheet of felt bonded to the front end portion of the wood base.

The fourth hammer assembly for a piano disclosed in the fourth prior art includes a hammer wood of relatively light wood and a hammer felt fixed to the hammer wood. Phenol resin or acrylic resin is impregnated into the hammer wood so as to improve mechanical properties such as tenacity and uniformity.

However, the prior art hammer assemblies encounter the following problems. The problem inherent in the first hammer assembly is the weights, because the manufacturer tailors the hammer heads depending upon the note ranges. Another problem is the complicated assembling work, because the weight requires the hole previously formed in the piece of rubber.

The second and third prior art hammer assemblies encounter a problem in the adhesion. The hammer base is adhered to the hammer wood, and the outer skin is adhered the front surface portion of the hammer base. The adhesion consumes time, and is not suitable for a mass-production.

The fourth prior art hammer assembly encounters a problem in that the weight is not precisely controllable. The wood is not constant in porosity. The amount of synthetic resin impregnated is dependent on the porosity, and is not controllable.

Thus, the prior art hammer assemblies do not satisfy the manufacturer, and a new hammer assembly is required.

SUMMARY OF THE INVENTION

It is therefore an important object of the present invention to provide a piano hammer assemblies of which are easily regulated in size and weight.

It is also an important object of the present invention to provide a process of fabricating a hammer assembly which decreases the production cost.

To accomplish the object, the present invention proposes to regulate the weight of a hammer head by blending metallic powder with synthetic resin.

In accordance with one aspect of the present invention, there is provided a keyboard musical instrument comprising: a keyboard including a plurality of keys assigned notes of a scale, and turnable in response to a fingering of a player; a plurality of key action mechanisms respectively connected to the plurality of keys and selectively actuated by keys of the keyboard depressed by the player; a sound generating means for selectively generating sounds having the notes of the scale; and a plurality of hammer assemblies selectively driven for rotation by key action mechanisms actuated by the keys so as to cause the sound generating means to generate the sounds, and including respective hammer shanks turnable toward and from the sound generating means and respective hammer heads formed of metallic powder-containing synthetic resin and different in weight due to the content of the metallic powder.

In accordance with another aspect of the present invention, there is provided a process of fabricating hammer assemblies used in a keyboard musical instrument, comprising the steps of: a) preparing metallic powder, synthetic resin and a hammer shank; b) blending the metallic powder with the synthetic resin at a ratio so as to obtain metallic-powder containing synthetic resin; c) placing the hammer shank in a mold; d) supplying the metallic powder-containing synthetic resin heated over a melting point of the synthetic resin into the mold; and e) cooling the metallic powder-containing synthetic resin below the melting point so as to form a hammer assembly.

BRIEF DESCRIPTION OF THE DRAWINGS

The features and advantages of the piano and the process of fabricating a hammer assembly according to the present invention will be more clearly understood from the following description taken in conjunction with the accompanying drawings in which.

DESCRIPTION OF THE PREFERRED EMBODIMENTS

FIRST EMBODIMENT

Figure 1:
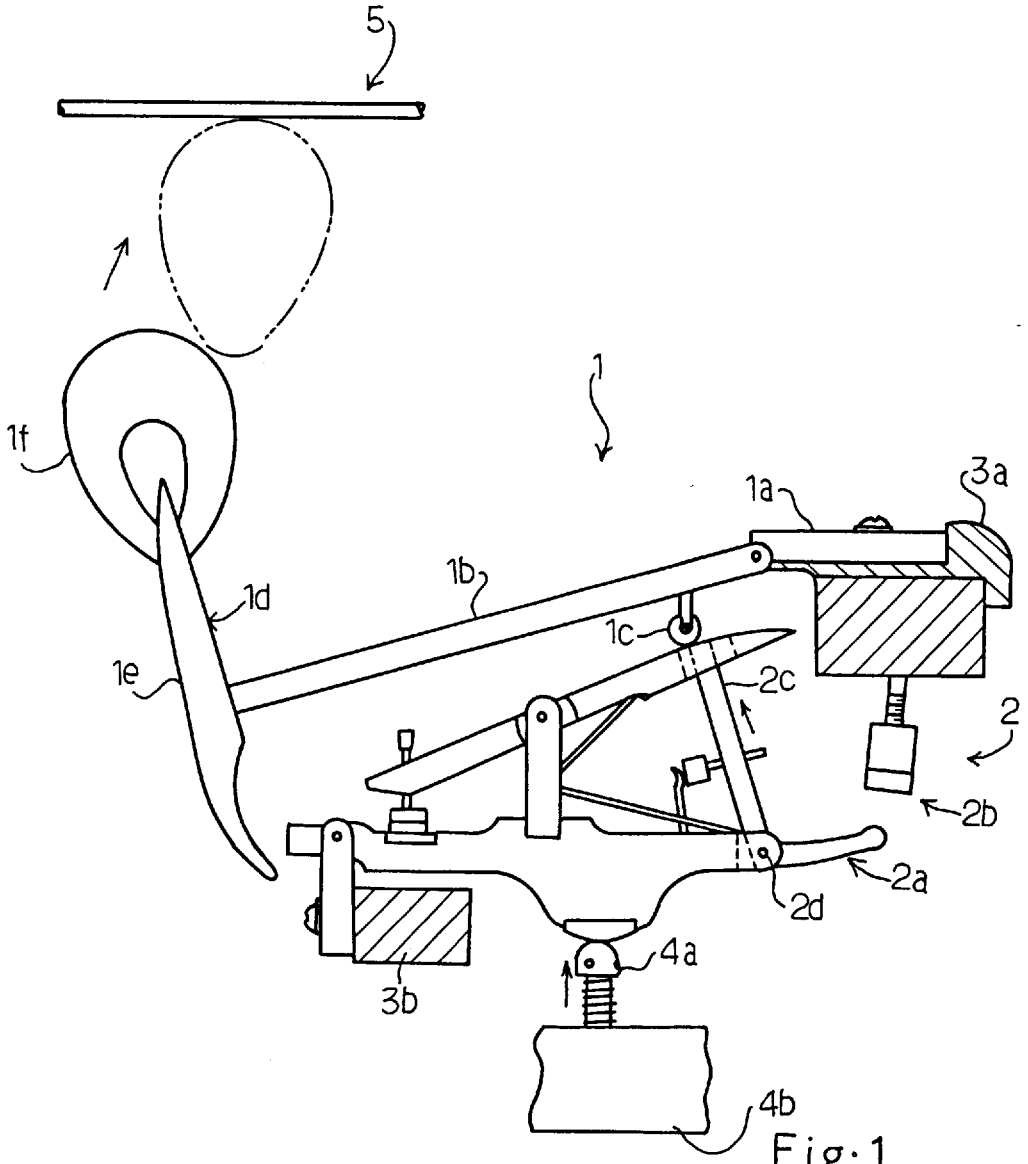
Fig·1 PRIOR ART
FIG. 1 is a side view showing the prior art hammer assembly associated with the key action mechanism.
Figure 2:
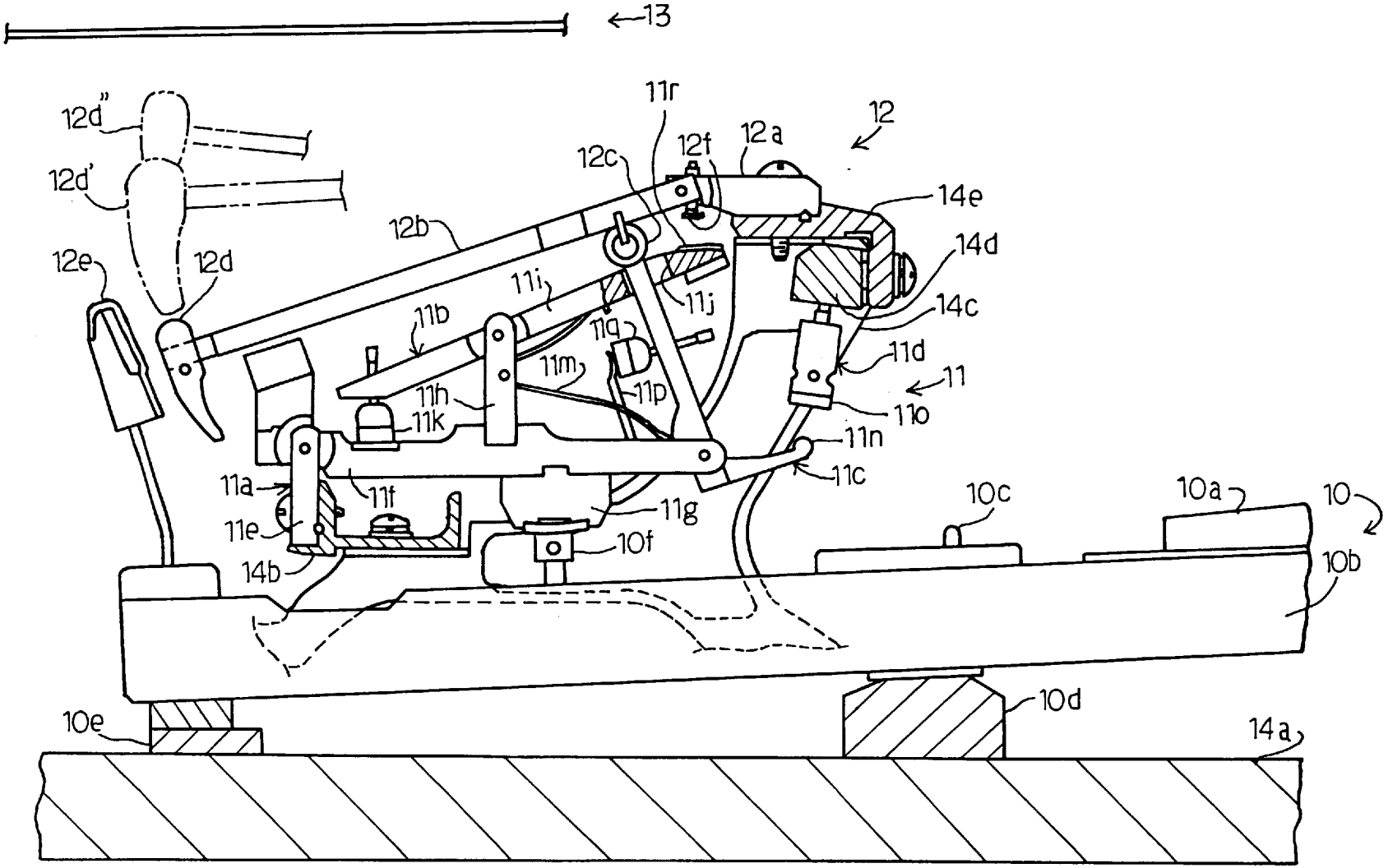
FIG. 2 is a side view showing essential parts of a grand piano according to the present invention.

Referring first to FIG. 2 of the drawings, a grand piano embodying the present invention largely comprises a keyboard 10, a plurality of key action mechanisms 11 functionally connected to the keyboard 10, a plurality of hammer assemblies 12 driven for rotation by the key action mechanisms 11 and a plurality of sets of music wires 13 struck by the hammer assemblies 12. Although damper mechanisms and pedal mechanisms are incorporated in the grand piano, they are omitted from FIG. 2 for the sake of simplicity.

In the following description, "front" is closer to a player fingering on the keyboard 10 than "rear", and "lateral" is the direction in which the keyboard 10 extends. The terms "clockwise direction" and "counter clockwise direction" are determined in a figure to which description refers.

Black and white keys 10*a* and 10*b* are incorporated in the keyboard 10, and are turnable around respective balance pins 10*c*. In this instance, eighty-eight black and white keys 10*a*/10*b* form in combination the keyboard 10. The balance pins 10*c* project from a balance rail 10*d*, and the balance rail 10*d* is mounted on a key bed 14*a*. A front rail (not shown) extend on the key bed 14*a* under the front end portions of the black and white keys 10*a* and 10*b*, and a rear rail 10*e* is provided under the rear end portions of the black and white keys 10*a* and 10*b*. The capstan button 10*f* upwardly project from each of the black and white keys 10*a*/10*b*, respectively. The black and white keys 10*a* and 10*b* are respectively associated with the sets of music wires 13, and notes of a scale are respectively assigned to the black and white keys 10*a* and 10*b* and, accordingly, the sets of music wires 13, respectively.

A player exerts force on the front end portion of the black/white key 10*a*/10*b*, and the black and white keys 10*a*/10*b* are rotated in the clockwise direction. The black and white keys 10*a*/10*b* transfer forces from the capstan buttons to the plurality of key action mechanisms 11. The black and white keys 10*a*/10*b* are staying in a rest position without the force, and the force moves the black/white key 10*a*/10*b* from the rest position toward an end position.

The plurality of key action mechanisms 11 are respectively associated with the black and white keys 10*a*/10*b*, and are supported by a whippen rail 14*b*. The whippen rail 14*b* laterally extends, and is supported by three or four action brackets 14*c*. Though not shown in FIG. 2, the action brackets 14*c* are provided on bracket blocks mounted on the key bed 14*a*.

The plurality of key action mechanisms 11 are similar in structure to one another, and each of the key action mechanisms 11 includes a whippen assembly 11*a*, a repetition lever assembly 11*b*, a jack 11*c* and a regulating button mechanism 11*d*. In detail, a whippen flange 11*e* is bolted to the whippen rail 14*b*, and a whippen 11*f* is turnably supported by the whippen flange 11*e*. A whippen heel 11*g* downwardly projects from the lower surface of the whippen 11*f*, and the capstan button 10*f* is held in contact with the lower surface of the whippen heel 11*g*.

A repetition lever flange 11*h* is upright from the upper surface of the whippen 11*f*, and a repetition lever 11*i* is turnably supported by the repetition lever flange 11*h* at an intermediate portion thereof. A through-hole 11*j* is formed in the front end portion of the repetition lever 11*i*, and a repetition stop button 11*k* downwardly projects from the rear end portion of the repetition lever 11*i*. A repetition spring

11*m* urges the repetition lever 11*i* in the counter clockwise direction, and the repetition stop button 11*k* is in contact with the upper surface of the repetition lever 11*f* during the rest position.

The jack 11*c* has a generally L-letter shape, and is turnably supported by the front end portion of the whippen 11*f*. The upper end portion of the jack 11*c* is inserted into the through-hole 11*i*, and the toe 11*n* is opposed to the regulating button 11*o* of the regulating button mechanism 11*d*. A jack stop spoon 11*p* is upright from the whippen 11*f*, and a jack button 11*q* rearwardly projects from the jack 11*c*. The repetition spring 11*m* urges the jack 11*c* in the counter clockwise direction, and the jack stop spoon 11*p* and the jack button 11*q* restrict the rotation of the jack 11*c* in the counter clockwise direction. The jack button 11*q* is projectable and retractable through bi-directional rotation, and, accordingly, the contact point between the jack stop spoon 11*p* and the jack button 11*q* is appropriately regulated through the bi-directional rotation.

The regulating button mechanisms 11*d* are supported by a regulating rail 14*d*, and the regulating rail 14*d* is bolted to a shank flange rail 14*e*. The shank flange rail 14*e* laterally extends, and is bolted to the action brackets 14*c*. The regulating button 11*o* is bi-directionally rotatable, and the gap between the regulating button 11*o* and the toe 11*n* is changeable through the bi-directional rotation of the regulating button 11*o*. The gap defines an escaping point of the hammer assembly 12 from the jack 11*c*.

The plurality of hammer assemblies 12 is similar in structure to one another, and each of the hammer assemblies 12 includes a hammer shank flange 12*a* bolted to the hammer shank flange rail 14*e*, a hammer shank 12*b* turnably supported by the hammer shank flange 12*a*, a hammer roller 12*c* rotatably connected to the hammer shank 12*b* and a hammer head 12*d* fixed to the hammer shank 12*b*. The hammer roller 12*c* is held in contact with the upper surface of the jack 11*c* at the home position thereof, and the hammer head 12*d* is softly received by a back check 12*e* after a rebound on the set of music wires 13. A drop screw 12*f* downwardly projects from the hammer shank flange 12*a*, and is brought into contact with a repetition skin 11*r* after an escape of the hammer assembly 12.

The hammer shank 12*b* is formed of wood such as birch or hornbeam, and the grain of wood is aligned with the longitudinal direction of the shank 12*b*. The hammer shank 12*b* may be formed of synthetic resin. The hammer head 12*d* is implemented by a single piece of metallic powder containing synthetic resin, and a hammer wood and a hammer felt does not form the hammer head 12*d*. It is preferable to use synthetic resin with large specific gravity such as, for example, nylon resin. Polyimide is available for the synthetic resin with large specific gravity. Any kind of metallic powder is available for the hammer heads 12*d*/12*d*′/12*d*″. In this instance, the hammer heads 12*d*/12*d*′/12*d*″ contain iron powder.

The hammer heads 12*d* are grouped by note ranges, i.e., low-pitched tones, middle-pitched tones and high-pitched tones, and the size and the weight are different between the hammer heads 12*d*, 12*d*′ and 12*d*″ depending upon the note ranges as described in connection with the prior art hammer assembly. The front surface of each hammer head 12*d*/12*d*′/12*d*″ is round, and the rear portion gradually becomes thin. The round front surface is rebound on the set of music wires 13, and.

The dimensions and the weight are independently regulable, and the hammer heads 12*d*/12*d*′/12*d*″ are optimized to given timbre. Even though the dimensions of each hammer head 12*d* to 12*d*″ are predetermined, the weight is freely regulated by changing the content of the metallic powder.

The key action mechanism 11 and the hammer assembly 12 behave in a performance as follows. Assuming now that a player depresses the white key 10*b* in the performance, the white key 10*b* turns around the balance key pin 10*c* in the clockwise direction, and the capstan button 10*f* pushes up the whippen heel 11*g*. This results in a rotation of the whippen 11*f* in the counter clockwise direction, and the jack 11*c* also turns around the whippen flange 11*e* without change the relative position to the whippen 11*f*. The front end portion of the white key 10*b* is continuously moved toward the end position.

While the jack 11*c* is turning around the whippen flange 11*e*, the jack pushes the hammer roller 12*c*, and the hammer shank 12*b* and the hammer head 12*d* slowly turn around the hammer shank flange 12*a* in the clockwise direction. When the toe 11*n* is brought into contact with the regulating button 11*o*, the regulating button 11*o* restricts the rotation of the jack 11*c* around the whippen flange 11*e*, and the whippen 11*f* pushed by the capstan button 10*f* causes the jack 11*c* to turn therearound in the clockwise direction. The jack 11*c* kicks the hammer roller 12*c*, and the hammer assembly 12 escapes from the jack 11*c*. Then, the hammer assembly 12 starts a free rotation toward the set of music wires 13. The escape gives unique key touch to the player.

The repetition skin 11*r* is brought into contact with the drop screw 12*f*, and the drop screw 12*f* restricts the rotation of the repetition lever 11*i* around the whippen flange 11*e*. As a result, the repetition lever 11*i* turns around the repetition flange 11*h* in the clockwise direction against the repetition spring 11*m*.

The hammer head 12*d* strikes the set of music wires 13, and the music wires 13 vibrates so as to generate the piano sound. The hammer head 12*d* rebounds on the set of music wires 13, and turns in the counter clockwise direction. The back check 12*e* softly receives the hammer head 12*d*, and the hammer assembly 12 stops the rotation.

The white key 10*b* has already reached the end position. When the player releases the white key 10*b*, the white key 10*b* turns around the balance key pin 10*c* in the counter clockwise direction, and the whippen assembly 11*a* and the jack 11*c* turn around the whippen flange 11*e* in the clockwise direction. The back check 12*e* leaves the hammer head 12*d*, and the repetition lever assembly 11*b* causes the jack 11*c* to be brought into contact with the hammer roller 12*c*, again. Finally, the white key 11*b* reaches the rest position. Thus, the black/white key 10*a*/10*b*, the key action mechanism 11, the hammer assembly 12 and the set of music wires 13 behave as similar to those of a standard grand piano, and generates the piano sound exactly turned to a predetermined timbre.

In this instance, the sets of music wires 13 as a whole constitute a sound generating means.

Figure 3A:
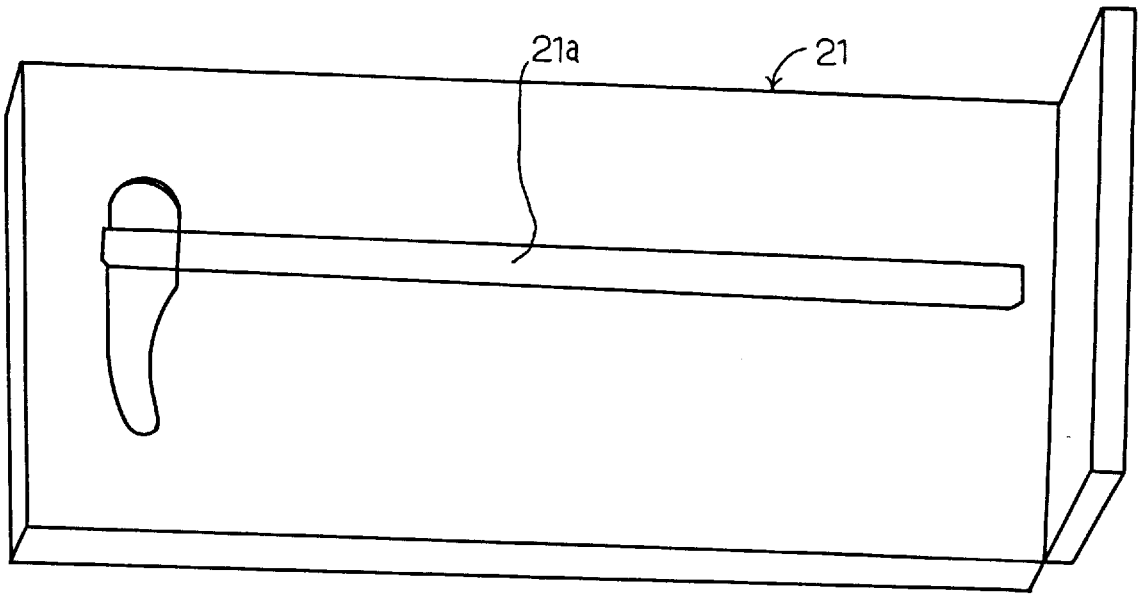
FIGS. 3A, 3B, 3C and 3D are views showing a process of fabricating a hammer assembly according to the present invention.

The hammer assembly 12 is formed through the following process sequence. First, the manufacturer prepares a mold 21, pellets 22 of nylon resin, iron powder 23 and the hammer shank 12*b*. The mold 21 has a recess 21*a* corresponding to the hammer shank 12*b* and the hammer head 12*d* as shown in FIG. 3A.

The iron powder 23 is blended with the pellet 22 at a predetermined ratio, and the pellet 22 and the iron powder 23 are put into a reservoir tank 24 equipped with a heater. The heater melts the synthetic resin, and an appropriate agitator (not shown) well blends the ion powder 23 with the molten synthetic resin. The blending ratio is exactly controlled rather than the impregnation, and the hammer heads 12*d* is strictly adjusted to the target weight.

Figure 3B:
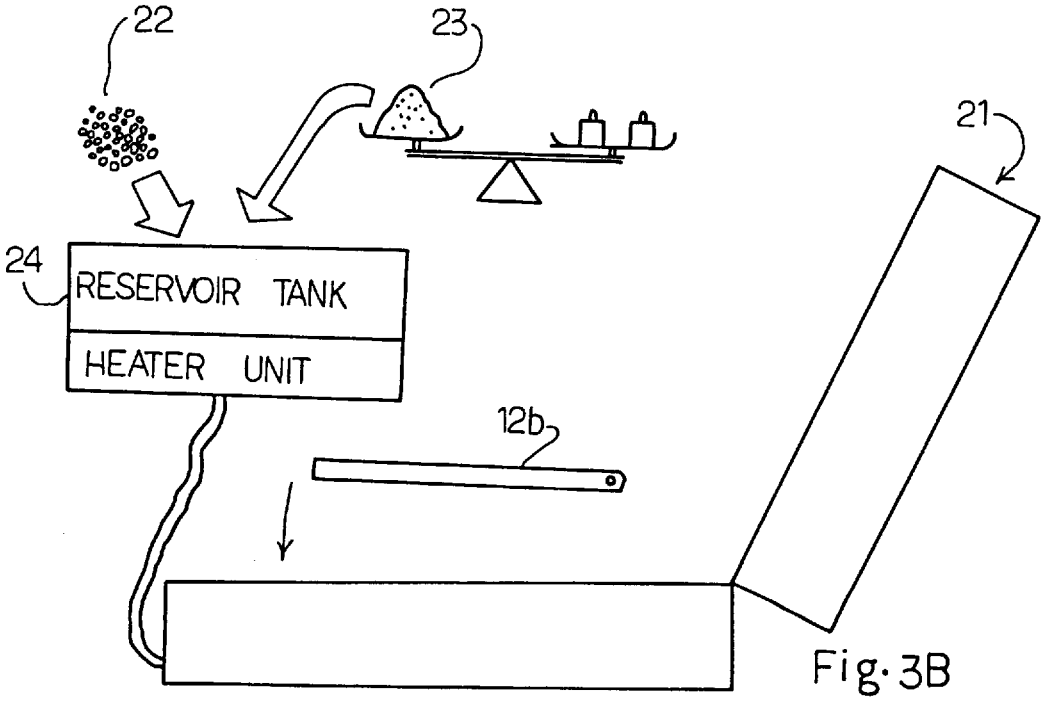
Figure 3C:
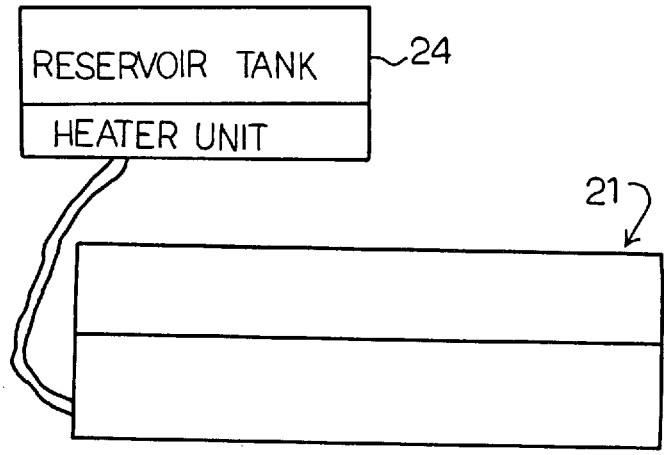

The hammer shank 12*b* is placed in the recess 21*a* as shown in FIG. 3B, and the mold 21 is closed (see FIG. 3C).

Figure 3D:
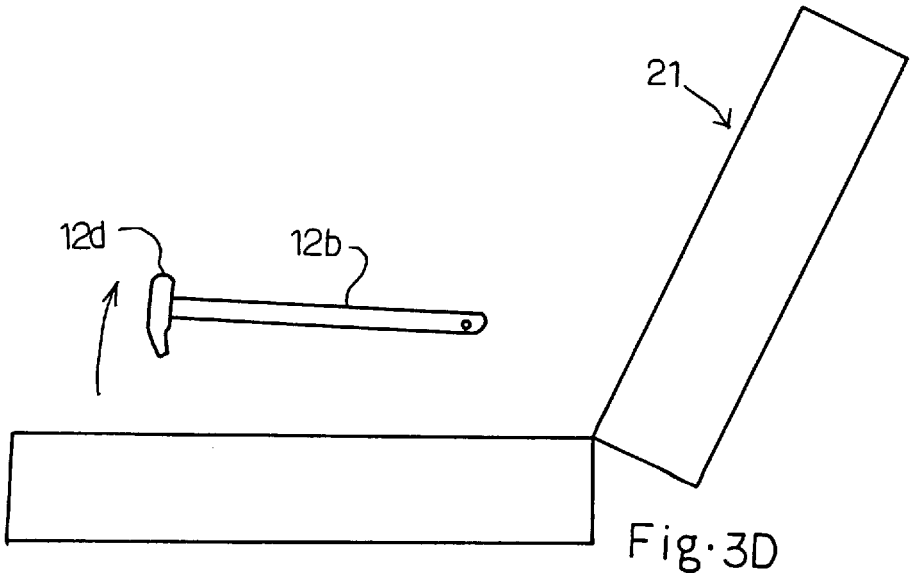
Figure 4:
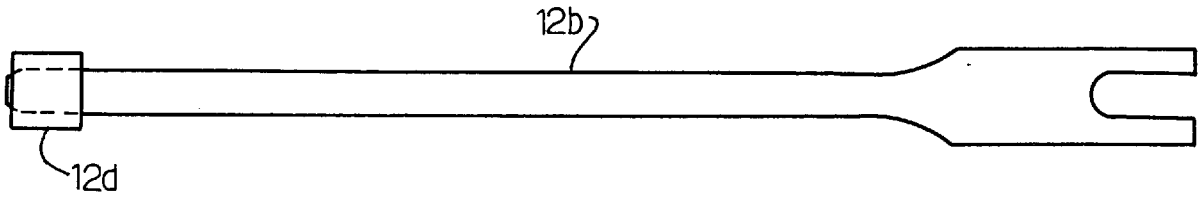
FIG. 4 is a plan view showing a hammer assembly incorporated in the grand piano.
Figure 5:
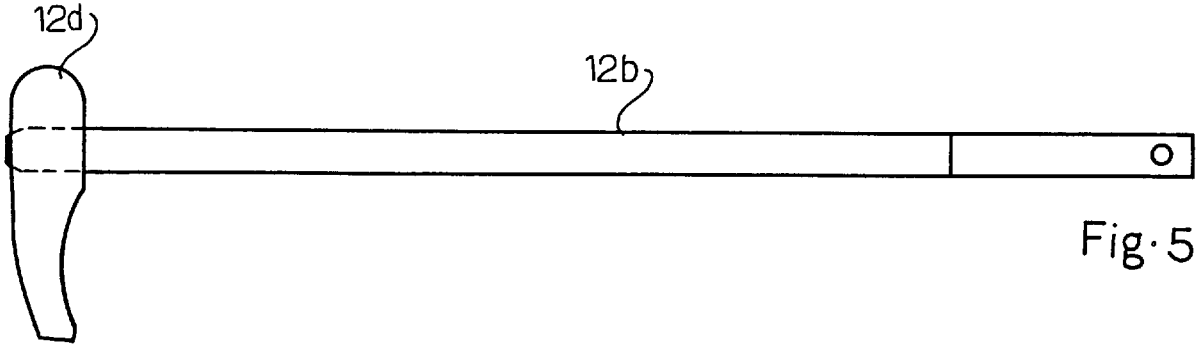
FIG. 5 is a side view showing the hammer assembly.

The metallic powder containing synthetic resin is supplied from the reservoir tank 24 to the mold 21, and fills a vacant space of the recess. The mold 21 is cooled below the melting point of the synthetic resin, and forms the hammer head 12*d*. The hammer shank 12*b* is integrated with the hammer head 12*d*, and is taken out from the mold 21 as shown in FIG. 3D.

The hammer shank 12*b* is integrated with the hammer head 12*d* through a molding, and a time-consuming adhering step is not incorporated in the fabrication process. Thus, the fabrication process according to the present invention is simpler than those of the prior art, and reduces the production cost.

When the hammer heads 12*d'* and 12*d"* are integrated with the hammer shank 12*b*, the ion powder is blended with the synthetic resin at different ratios, and the hammer heads 12*d'* and 12*d"* have respective weights different from the hammer head 12*d*.

As will be understood from the foregoing description, the hammer heads 12*d*/12*d'*/12*d"* are respectively optimized independently from their dimensions, and the timbre of piano sounds is arbitrarily changed. Moreover, the hammer shank 12*b* is integrated with the hammer head 12*d*/12*d'*/12*d"* through the molding, and the simple assembling work decreases the production cost of the hammer assembly 12.

SECOND EMBODIMENT

Figure 6:
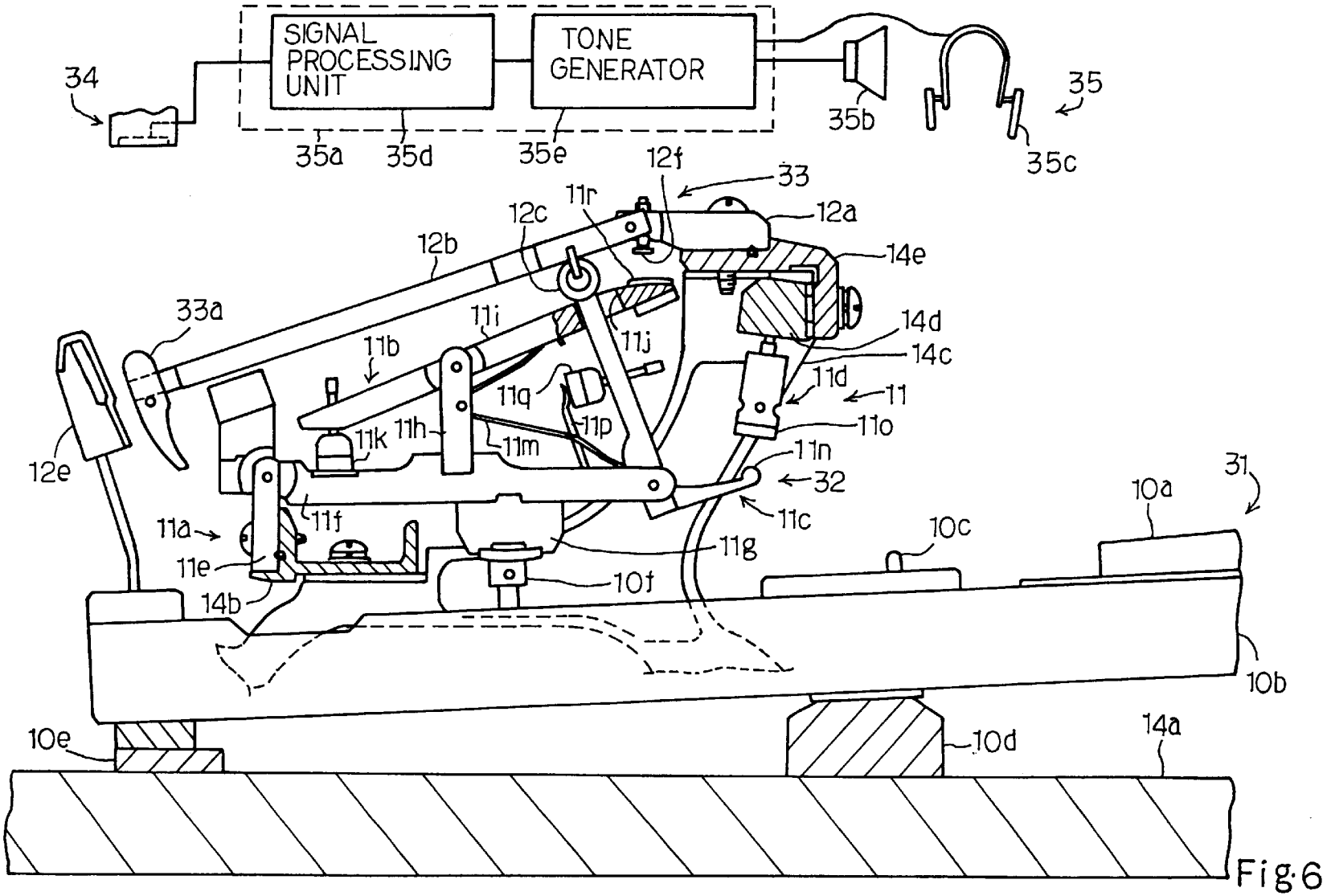
FIG. 6 is a side view showing the structure of an electric piano according to the present invention.

Turning to FIG. 6 of the drawings, an electronic piano embodying the present invention largely comprises a keyboard 31, a plurality of key action mechanisms 32, a plurality of hammer assemblies 33, a plurality of impact pads 34 and an electronic sound generating system 35. The keyboard 31, the key action mechanism 32 and the hammer assembly 33 are similar to those of the grand piano, and the component parts are labeled with the references designating corresponding parts of those of the first embodiment without detailed description for the sake of simplicity.

The hammer assemblies 33 have respective hammer heads 33*a*, and the hammer heads 33*a* are formed of metallic powder containing synthetic resin. Although the hammer heads 12*d*/12*d'*/12*d"* of the grand piano are different in size, all of the hammer heads 33*a* of the electronic piano are identical with one another. However, the hammer heads 33*a* are different in weight, and the weight is decreased from the low-pitched tone range through the middle-pitched tone range to the high pitched tone range as similar to a standard grand piano by changing the content of metallic powder. The hammer heads 33*a* give the fingers of a player loads equal to those of the grand piano. The hammer assemblies 33 are economical, because only one kind of mold is required.

In this instance, the hammer heads 33*a* for the low-pitched tone range, the hammer heads 33*a* for the middle-pitched tone range and the hammer heads 33*a* for the middle-pitched tone range are regulated to 4.1 grams per cubic centimeter, 3.2 grams per cubic centimeter and 2.5 grams per cubic centimeter, respectively.

The impact pads 34 are respectively opposed to the hammer heads 33*a*, and piezo-electric elements are respectively incorporated in the impact pads 34. When the hammer heads 33*a* strike the impact pads 34, the piezo-electric elements converts the impacts to electric signals representative of the intensity.

The piezo-electric elements of the impact pads 34 are connected to a controller 35*a*, and the controller 35*a* tailors an analog audio signal on the basis of the electric signals. The analog audio signal is supplied to a speaker system 35*b* and/or a headphone 35*c*, and the speaker system 35*b* and/or headphone 35*c* generates electronic sounds. Thus, the impact pads 34, the controller 35*a*, the speaker system 35*b* and the headphone 35*c* as a whole constitute a sound generating means.

A typical example of the electronic piano is disclosed in Japanese Patent Publication of Unexamined Application No. 62-208094, and no further description is incorporated hereinbelow.

The electronic piano behaves in a performance as follows. A player is assumed to depress the white key 10*b* in the performance, the white key 10*b* turns around the balance key pin 10*c* in the clockwise direction, and the capstan button 10*f* pushes up the whippen heel 11*g*. This results in a rotation of the whippen 11*f* in the counter clockwise direction, and the jack 11*c* also turns around the whippen flange 11*e* without change the relative position to the whippen 11*f*. The front end portion of the white key 10*b* is continuously moved toward the end position.

While the jack 11*c* is turning around the whippen flange 11*e*, the jack pushes the hammer roller 12*c*, and the hammer shank 12*b* and the hammer head 12*d* slowly turn around the hammer shank flange 12*a* in the clockwise direction. When the toe 11*n* is brought into contact with the regulating button 11*o*, the regulating button 11*o* restricts the rotation of the jack 11*c* around the whippen flange 11*e*, and the whippen 11*f* pushed by the capstan button 10*f* causes the jack 11*c* to turn therearound in the clockwise direction. The jack 11*c* kicks the hammer roller 12*c*, and the hammer assembly 12 escapes from the jack 11*c*. Then, the hammer assembly 12 starts a free rotation toward the set of music wires 13. The escape gives unique key touch to the player.

The repetition skin 11*r* is brought into contact with the drop screw 12*f*, and the drop screw 12*f* restricts the rotation of the repetition lever 11*i* around the whippen flange 11*e*. As a result, the repetition lever 11*i* turns around the repetition flange 11*h* in the clockwise direction against the repetition spring 11*m*.

The hammer head 12*d* strikes the impact pad 34, and the impact pad 34 converts the impact to the electric signal. The signal processing unit 35*d* periodically scans the impact pads 34, and identifies the impact pad 34 which supplies the electric signal. The signal processing unit 35*d* supplies a series of music data codes representative of a key-on, a key velocity representative of the intensity of the impact and a key-off, and the tone generator 35*e* tailors the waveform for the analog audio signal. The analog audio signal is supplied to the speaker system 35*b* and/or headphone 35*c*, and the electronic sound is generated therefrom. The timbre of the electronic sound may be adjusted to that of a standard piano.

The hammer head 12*d* rebounds on the impact pad 34, and turns in the counter clockwise direction. The back check 12*e* softly receives the hammer head 12*d*, and the hammer assembly 12 stops the rotation.

The white key 10*b* has already reached the end position. When the player releases the white key 10*b*, the white key 10*b* turns around the balance key pin 10*c* in the counter clockwise direction, and the whippen assembly 11*a* and the jack 11*c* turn around the whippen flange 11*e* in the clockwise direction. The back check 12*e* leaves the hammer head 12*d*, and the repetition lever assembly 11*b* causes the jack 11*c* to be brought into contact with the hammer roller 12*c*, again. Finally, the white key 11*b* reaches the rest position.

The hammer assembly 33 is fabricated through a process sequence similar to that of the first embodiment, and the process sequence is omitted for avoiding repetition.

The hammer assemblies 33 achieve all the advantages of the first embodiment.

THIRD EMBODIMENT

Figure 7:
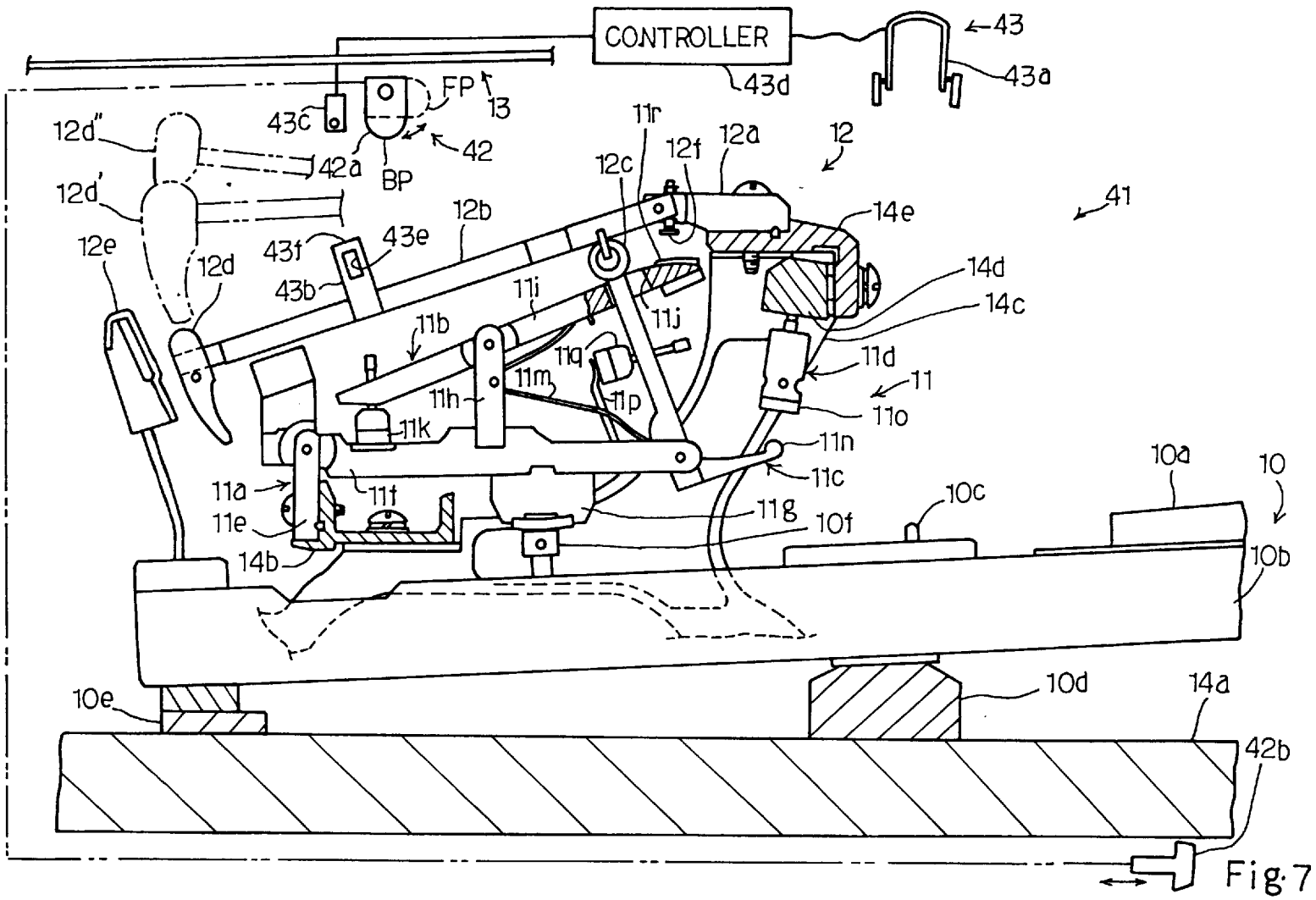
FIG. 7 is a side view showing the structure of a silent piano according to the present invention.

Turning to FIG. 7 of the drawings, a silent piano embodying the present invention largely comprises a grand piano 41, a silent system 42 and an electronic sound generating system 43. The grand piano 41 is similar to the grand piano implementing the first embodiment, and component parts of the grand piano 41 are labeled with the references designating corresponding parts of the first embodiment without detailed description.

The silent system includes a shank stopper 42*a* changeable between a free position FP and a blocking position BP and a change-over mechanism 42*b* for changing the position of the shank stopper 42*a*. A player manipulates the change-over mechanism 42*b*, and the change-over mechanism 42*b* moves the shank stopper 42*a* from the free position FP to the blocking position BP and vice versa. While the shank stopper 42*a* is staying in the free position FP, the hammer assemblies 12 strike the sets of music wires 13 as similar to those of the grand piano, and the silent piano behaves as similar to the grand piano. On the other hand, when the shank stopper 42*a* enters into the blocking position BP, the hammer shanks 12*b* are brought into contact with the shank stopper 4*a* before impact against the sets of music wires 13, and the hammer heads 12*d*/12*d*′/12*d*″ rebound thereon. Therefore, no acoustic piano sound is generated. However, the electronic sound generating system 43 generates electronic sounds from a headphone 43*a*.

The electronic sound generating system 43 includes shutter plates 43*b* attached to the hammer shanks 12*b*, respectively, hammer sensors 43*c* associated with the shutter plates 43*b* for monitoring the hammer motion, a controller 43*d* for generating an audio signal and the headphone 43*a*. A speaker system may be further incorporated in the electronic sound generating system 43.

The hammer sensor 43*c* is implemented by a photo-interrupter, and the shutter plate 43*b* interrupts the light beam radiated from the photo-interrupter. The shutter plate 43*b* has a window, and the light beam is only interrupted by the leading end portion 43*f*. The photo-interrupter changes the potential level of a hammer motion signal for a time period when the leading end portion 43*f* passes in front of the photo-interrupter. The controller 43*d* periodically scans signal ports respectively assigned to the hammer sensors 43*c*, and can identify the hammer sensor 43*c* changing the potential level of the hammer motion signal. The time period is inversely proportional to the hammer velocity, and the hammer velocity is proportional to the intensity of the impact against the set of music wires 13. For this reason, the controller 43*d* can estimate the intensity of impact on the basis of the time period. When the controller 43*d* acknowledges the hammer motion of the white key 10*b*, the controller 43*d* generates a series of music data codes representative of a key-on, a key velocity representative of the intensity of impact and a key-off, and a tone generator tailors the waveform of the audio signal on the basis of the series of music data codes. The audio signal is supplied to the headphone 43*a*, and the headphone 43*a* generates an electronic sound corresponding to the acoustic piano sound to be generated by the set of music wires 13.

While a player is performing a music through the acoustic piano sounds, the hammer heads 12*d*/12*d*′/12*d*″ impart a timbre expected by a designer to the acoustic piano sounds. The hammer heads 12*d*/12*d*′/12*d*″ give the unique key touch to the fingers of the player in the performance through the electronic sounds.

Although particular embodiments of the present invention have been shown and described, it will be obvious to those skilled in the art that various changes and modifications may be made without departing from the spirit and scope of the present invention.

For example, the hammer assemblies according to the present invention may be incorporated in an upright piano.

The hammer shank may be formed of the metallic powder containing synthetic resin. In this instance, the process of fabricating a hammer assembly is simpler than those of the first to third embodiments.

What is claimed is:

1. A keyboard musical instrument comprising:

a keyboard including a plurality of keys assigned notes of a scale, and turnable in response to a fingering of a player;

a plurality of key action mechanisms respectively connected to said plurality of keys and selectively actuated by keys of said keyboard depressed by said player;

a sound generating means for selectively generating sounds having said notes of said scale; and a plurality of hammer assemblies selectively driven for rotation by said key action mechanisms actuated by said keys so as to cause said sound generating means to generate said sounds, and including respective hammer shanks turnable toward and from said sound generating means and respective hammer heads formed of metallic powder-containing synthetic resin and different in weight due to the content of said metallic powder.

2. The keyboard musical instrument as set forth in claim 1, in which said sound generating means is implemented by a plurality of sets of music wires, and said hammer heads are further different in size.

3. The keyboard musical instrument as set forth in claim 1, in which said sound generating means includes a plurality of impact pads respectively associated with said plurality of hammer assemblies and having respective force-to-voltage converting elements for generating electric signals representative of intensities of impacts of said hammer heads, a controller connected to said force-to-voltage converting elements for generating an audio signal on the basis of said electric signals and a sound producing unit for generating electronic sounds from said audio signal.

4. The keyboard musical instrument as set forth in claim 3, in which said hammer heads are identical in size, and are decreased in weight from those of low-pitched tones through those of middle pitched-tones and those of high-pitched tones.

* * * * *